US005553341A

United States Patent [19]

Wiedeck et al.

[11] Patent Number: 5,553,341

[45] Date of Patent: Sep. 10, 1996

[54] ROLLER CARRIAGE FOR PORTABLE BRIDGES

[75] Inventors: Hans-Norbert Wiedeck, Mülhelm/Ruhr; Heinz Füchtey, Essen, both of Germany

[73] Assignee: Krupp Fordertechnik GmbH, Duisburg, Germany

[21] Appl. No.: 419,028

[22] Filed: Apr. 10, 1995

[30] Foreign Application Priority Data

Apr. 12, 1994 [DE] Germany ..... 9406015 U

[51] Int. Cl.[6] ..... E01D 21/00

[52] U.S. Cl. ..... 14/2.4; 14/2.5

[58] Field of Search ..... 14/2.4, 2.5, 72.5

[56] References Cited

FOREIGN PATENT DOCUMENTS

| | | | |
|---|---|---|---|
| 2530359 | 1/1977 | Germany . | |
| 9308340 | 10/1993 | Germany . | |
| 1266919 | 10/1986 | U.S.S.R. | 14/2.4 |

*Primary Examiner*—David J. Bagnell
*Assistant Examiner*—James A. Lisehora
*Attorney, Agent, or Firm*—Herbert Dubno

[57] ABSTRACT

A roller carriage for portable bridges or bridge parts have a rocker carrier connected by a support stud to the bridge structure while the rocker bodies are connected to the rocker carrier by pins which are formed in one piece and inseparably with the rocker bodies. A pair of rollers are journaled on each of the rocker bodies.

3 Claims, 1 Drawing Sheet

ROLLER CARRIAGE FOR PORTABLE BRIDGES

FIELD OF THE INVENTION

Our present invention relates to a roller carriage for portable bridges and bridge parts, i.e. to a roller carriage of the type which can be affixed to an outrigger of a portable bridge part and by means of which the bridge structure is guided.

BACKGROUND OF THE INVENTION

Roller carriages for bridge structures have been provided heretofore and generally utilized a rocker carrier with a lateral stud pivotally engaged in the outrigger for the truss structure which is to be displaced on rails or other support members via such roller carriages. A pair of rockers are in turn mounted on the rocker carrier and each of the rockers may be provided with a pair of rollers.

Typical of such structures are those described in German patent document DE OS 25 30 359 and DE GM 93 08 340.8.

In the system of DE OS 25 30 359, the support pin of the rocker which is received in the rocker carrier and thus supports the rocker and its pair of rollers on the rocker carrier is force-fitted or frozen in place. The press fit of the pin which is thus separable from the rocker body creates problems in, for example, stress between the bolt and the rocker carrier. Since this pin must conduct the forces between the rocker carrier and the rollers, with time the bore in the rocker carrier tends to enlarge and the resulting play can create problems in the travel of the carriage. The carriage becomes unreliable with time.

In the system of DE GM 93 08 340.8, an attempt is made to avoid these drawbacks by casting the support pin in situ. While this approach has been successful in providing a tight fit with less chance of damage with time, in practice the approach is expensive and complex and tends to be avoided for economic reasons.

OBJECTS OF THE INVENTION

It is, therefore, the principal object of the present invention to provide a roller carriage which is free from the drawbacks of the earlier systems and, in particular, which can avoid the problems encountered with the system of DE OS 25 30 359 at substantially lower cost and with greater ease and simplicity than the approach of DE GM 93 08 340.8.

Another object of this invention is to provide a simpler roller carriage for the purposes described which will be free from problems encountered with force-fitted pins heretofore.

SUMMARY OF THE INVENTION

These objects and others which will become apparent hereinafter are attained, in accordance with the invention, in a roller carriage for the purposes described in which the pins connecting the rocker bodies with the rocker carrier are inseparable from the rocker bodies, i.e. are formed in one piece therewith.

The roller carriages of the invention can use, therefore, a single casting for both the pin and the roller body, thereby reducing the number of cast and forged parts which are required and simplifying the assembly and mounting procedures. There is, of course, a concomitant cost saving as a result. According to a feature of the invention, the support pins which are formed in one piece and inseparably with the rocker bodies, are received in sleeves or bushings of the rocker carrier.

It has been found to be advantageous, moreover, to provide the diameters of these support pins such that they exceed the diameters of the pins necessary to withstand the stresses to which the pin is subject. In other words from a point of view of the pin diameter, the pins are overdimensioned, thereby reducing the concentration of stress and increasing the area of distribution of any such stress.

In particular, the roller carriage for a bridge structure, namely, a portable bridge or a bridge part, for mounting on an outrigger of the bridge structure in a system, for example, of the type described in DE OS 25 30 359, can comprise:

- a rocker carrier elongated in a direction of travel of the roller carriage and formed with a lateral support stud rotatable connecting the rocker carrier with the structure;
- a pair of rocker bodies each having a central lateral support pin formed in one piece inseparably with the respective rocker body and engaging laterally in a respective end of the rocker carrier; and
- a respective pair of rollers Journaled on each of the rocker bodies.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
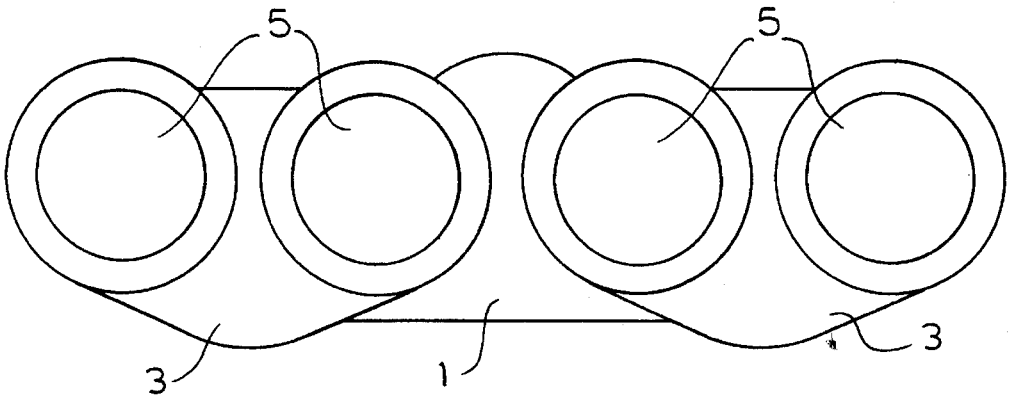
FIG. 1 is a front view of a roller carriage according to the invention.
Figure 2:
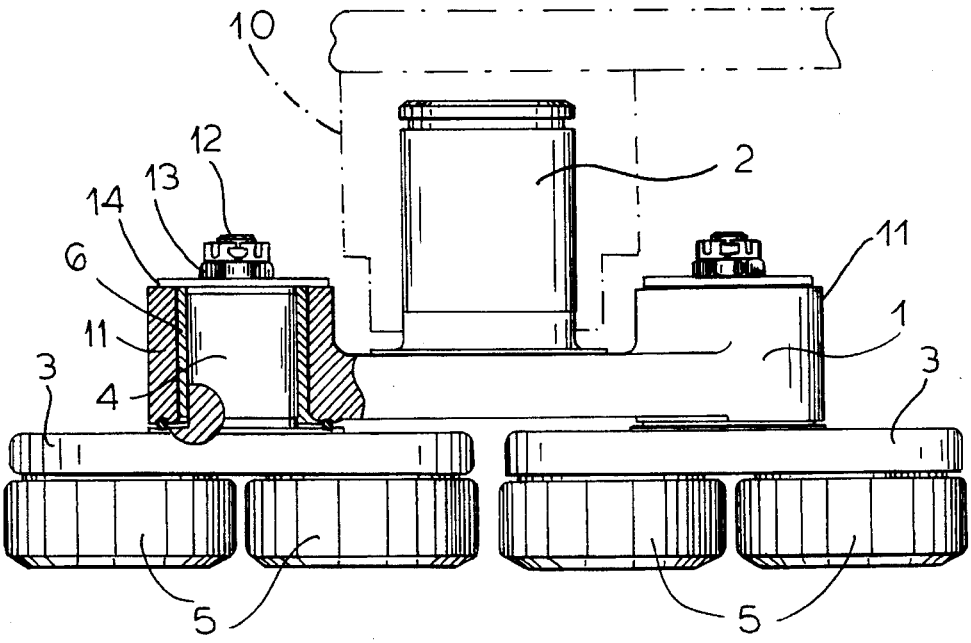
FIG. 2 is a plan view of the roller carriage of FIG. 1 partly broken away.

The roller carriage of the invention as seen in FIGS. 1 and 2 comprises a rocker carrier 1 which is connected by means of a support stud 2 to an outrigger of a bridge structure represented in dot dash lines at 10 in FIG. 2. The rocker carrier 1 comprises two symmetrically disposed bosses 11 with cylindrical bores receiving sleeves or bushings 6.

The rocker carrier carries two symmetrically arranged rockers 3 whose rocker bodies are formed unitarily, i.e. in one piece and inseparably with support pins 4 which are received in the sleeves or bushings 6. The rocker bodies 3 with their pins 4 can be formed as castings which are forged to the final shape, the pins then being machined to fit into the bushings or sleeves 6. The pins 4 can be formed in one piece with threaded bolts 12 onto which locking nuts 13 can be applied to press respective washers 14 against one end of the boss 11, the rocker body 3 around the respective pin 4 being drawn against the other end of each boss 11.

Each of the rocker bodies 3 carries a pair of rollers 5 which ride on the track along which the bridge structure is displaced via the carriage shown in FIGS. 1 and 2.

We claim:

1. A roller carriage for a portable bridge structure, said roller carriage comprising:

- a rocker carrier elongated in a direction of travel of the roller carriage and formed with a lateral support stud rotatably connecting said rocker carrier with said structure;

a pair of rocker bodies each having a central lateral support pin formed in one piece inseparably with the respective rocker body and engaging laterally in a respective end of said rocker carrier, whereby said pair of rocker bodies have lateral support pins; and a respective pair of rollers journaled on each of said rocker bodies, said rocker carrier being formed with respective sleeves, each of said sleeves receiving a respective one of said lateral support pins, each of said lateral support pins having a diameter greater than a diameter sufficient to withstand stress applied to the lateral support pins, said rocker carrier being formed with respective cylindrical bosses receiving said sleeves and said pins, each of said rocker bodies engaging one end of the respective boss, said pins being formed with threaded bolts, the rocker carrier further comprising washers fitted over said bolts and engaging opposite ends of the respective bosses, and nuts threaded onto said bolts against said washers.

2. A roller carriage for a portable bridge structure, said roller carriage comprising:

a rocker carrier elongated in a direction of travel of the roller carriage and formed with a lateral support stud rotatably connecting said rocker carrier with said structure;

a pair of rocker bodies each having a central lateral support pin formed in one piece inseparably with the respective rocker body and engaging laterally in a respective end of said rocker carrier, whereby said pair of rocker bodies have lateral support pins; and a respective pair of rollers journaled on each of said rocker bodies, each of said lateral support pins having a diameter greater than a diameter sufficient to withstand stress applied to the lateral support pins, said rocker carrier is formed with respective cylindrical bosses receiving said pins, each of said rocker bodies engaging one end of the respective boss, said pins being formed with threaded bolts, the rocker carrier further comprising washers fitted over said bolts and engaging opposite ends of the respective bosses, and nuts threaded onto said bolts against said washers.

3. A roller carriage for a portable bridge structure, said roller carriage comprising:

a rocker carrier elongated in a direction of travel of the roller carriage and formed with a lateral support stud rotatably connecting said rocker carrier with said structure;

a pair of rocker bodies each having a central lateral support pin formed in one piece inseparably with the respective rocker body and engaging laterally in a respective end of said rocker carrier, whereby said pair of rocker bodies have lateral support pins; and a respective pair of rollers journaled on each of said rocker bodies, said rocker carrier is formed with respective cylindrical bosses receiving said pins, each of said rocker bodies engaging one end of the respective boss, said pins being formed with threaded bolts, the rocker carrier further comprising washers fitted over said bolts and engaging opposite ends of the respective bosses, and nuts threaded onto said bolts against said washers.

* * * * *